United States Patent [19]

Engelhardt

[11] Patent Number: 4,718,590

[45] Date of Patent: Jan. 12, 1988

[54] FASTENER DISPENSING DEVICES

[76] Inventor: Bernard Engelhardt, 51 Abbeywood Trail, Don Mills, Ontario, Canada, M3B 3B4

[21] Appl. No.: 889,743

[22] Filed: Jul. 28, 1986

[51] Int. Cl.[4] ..... B65C 7/00

[52] U.S. Cl. ..... 227/67; 227/109; 227/120

[58] Field of Search ..... 227/67, 40, 48, 109, 227/120; 221/93, 232

[56] References Cited

U.S. PATENT DOCUMENTS

| | | | |
|---|---|---|---|
| 213,000 | 3/1879 | Sperry | 221/304 X |
| 2,069,878 | 2/1937 | Flood | 227/67 X |
| 2,503,903 | 4/1950 | Cunningham et al. | 227/48 X |
| 3,022,508 | 2/1962 | Ruskin | 221/232 X |
| 3,070,260 | 12/1962 | Smith | 221/232 X |
| 3,103,666 | 9/1963 | Bone | 227/67 |
| 3,308,989 | 3/1967 | Alltop et al. | 221/232 |
| 3,393,831 | 7/1968 | Stewart | 221/232 |
| 3,412,895 | 11/1968 | Hilton | 221/268 |
| 3,735,908 | 5/1973 | Kinney et al. | 227/67 |
| 3,924,788 | 12/1976 | Furutu | 227/67 |
| 4,038,922 | 8/1977 | McGregor | 271/129 X |
| 4,085,863 | 4/1978 | Johnson | 221/304 X |
| 4,323,183 | 4/1982 | Duchin | 227/18 X |
| 4,405,124 | 9/1983 | Watanabe | 271/138 X |
| 4,487,354 | 12/1984 | Ueno | 227/67 |
| 4,538,754 | 9/1985 | Furutsu | 227/67 |
| 4,610,384 | 9/1986 | Duchin | 227/167 |

FOREIGN PATENT DOCUMENTS

| | | |
|---|---|---|
| 318771 | 1/1932 | Canada . |
| 753510 | 2/1967 | Canada . |
| 1103625 | 6/1981 | Canada . |

*Primary Examiner*—E. R. Kazenske
*Assistant Examiner*—James L. Wolfe
*Attorney, Agent, or Firm*—Fleit, Jacobson, Cohn & Price

[57] ABSTRACT

A positioning mechanism positions a product so that one side of the product is adjacent the front end of the needle member of the dispensing device. The positioning means is moved towards the needle by an arrangement which is activated when the trigger of the fastener and a tag dispensing device is moved in a triggering direction. Thus, the product is caused to approach the needle member, to be pierced by the needle member, and to slide on the needle member so that the needle member extends through the product and the front end of the needle member extends beyond the other side of the product a sufficient distance for the dispensing device to dispense the fastener.

22 Claims, 10 Drawing Figures

FASTENER DISPENSING DEVICES

BACKGROUND OF INVENTION

1. Field of the Invention

The invention relates to improvements in a fastener dispensing device which dispensing device includes a trigger means for activating a push rod to extend through a stationary hollow needle member, the needle member having a free, front end, whereby to anchor a fastener to a fabric material or other pierceable material.

More specifically, the invention relates to means for positioning the product over the stationary needle during the fastening operation.

Typically, the fastener is used to attach tags, labels, or the like to the fabric material or other product in such a manner that, after the fastening operation is completed, the tag is mounted on the fastener and the fastener is anchored to the product so that the tag is attached to the product by the fastener.

The invention also relates to a tag dispenser for use with the fastener dispensing device which automatically places a tag in position to be mounted on the stationary needle before each fastening operation.

The invention also relates to the tag dispenser, per se.

2. Description of Prior Art

Devices of the above nature are known in the art as illustrated in, for example, U.S. Pat. Nos. 2,069,878, Flood, Feb. 9, 1937, 3,103,666, Bone, Sept. 17, 1963, 3,924,788, Furutu, Dec. 9, 1975, 4,487,354, Ueno, Dec. 11, 1984 and 4,538,754, Furutsu, Sept. 3, 1985.

The above patents relate to the device per se and to improvements in the dispensing operation of the device. In operation of the device, the material to which the fastener is to be anchored is held in one hand with two fingers of the one hand being placed on either side of the spot at which the fastener is to be anchored. The fingers spread the material apart whereby to maintain the material between the fingers taut and rigid. The device is held in the other hand and a tag is mounted, usually manually, on the needle. The needle is pushed through the material between the two fingers of the one hand. It will be appreciated that it is necessary to so hold the material as a taut surface is necessary if the needle is to penetrate the material.

The needle is pushed through the material from one side (usually the front) to the other side (usually the back) and one bar of the fastener remains on the one side while the other bar of the fastener is disposed on the other side, as described in the above patents, so that the fastener is anchored to the material. The tag remains on the one side mounted on the filament of the fastener (the filament connects the bars) so that the tag is attached to the material by the fastener.

The device is used for affixing tags to clothing and other products made of a pierceable material. The tags can contain such information as the size of the product, the cost of the product or inventory information for the retail outlet.

The problem with the above-described procedure is that it is, outside of the affixing step performed by the device, an entirely manual procedure which is therefore labor intensive and, accordingly, very costly. In addition, there is the danger that a worker applying the fastener will pierce his finger with the needle so that there is a certain degree of danger to the operators of the procedure. Further, because the needle of the dispensing device is stationary, the fastening operation is not easily automated.

It can be seen that the manual steps which are performed by an operator are as follows:

1. Mounting the tag on the needle;
2. Holding the material;
3. Bringing the needle to the material (or vice-versa); and
4. Piercing the material with the needle and then dispensing the fastener.

Although there are some machines which automate some or all of the above steps, the machines are typically fairly large, complex and expensive. In addition, the machines are fixed in place so that it is always necessary to bring the articles of clothing (or other product) to the machine. Thus, although these machines do eliminate manual labor in one respect, they impose manual labor in a different respect, that is, it is necessary to manually bring the product to the machines and then to return the product to either hangers or other carriers after the fastening operation has been completed.

SUMMARY OF INVENTION

It is an object of the invention to provide an improvement to a fastener dispensing device of the above-described nature which overcomes the disadvantages of the prior art.

It is a more specific object of the invention to provide an improvement to a fastener dispensing device of the above-described nature which automates certain steps in the fastening procedure.

It is a more specific object of the invention to provide an improvement to a fastener dispensing device of the above-described nature which improvement automates the step of the positioning the product on the stationary needle of the dispensing device.

It is a still further object of the invention to provide an improvement to a fastener dispensing device of the above-described nature which automates the step of bringing the product to the needle, piercing the step of bringing the product to the needle, piercing the product with the needle and aiding in the dislodgement of the fastener from the dispensing device.

It is a still further object of the invention to provide a tag dispenser for use with the fastener dispensing device which automates the tag positioning step of the above procedure.

It is a still further object of the invention to provide a tag dispenser per se.

In accordance with a particular embodiment of the invention there is provided an improvement to a fastener dispensing device which device includes a trigger means for activating, when moved in a triggering direction, a push rod to extend through a hollow needle member, whereby to anchor a fastener in a pierceable product. The improvement includes a positioning means for positioning the product so that one side of the product is adjacent the front end of the needle member. A moving means moves the positioning means towards the needle member, the moving means being activated to move towards the needle member when the trigger means is moved in a triggering direction. Thus, the product is caused to approach the needle member to be pierced by the needle member and to slide on the needle member so that the needle member extends through the product and the front end of the needle member extends beyond the other side of the product a sufficient distance for the dispensing device to dispense the fastener.

BRIEF DESCRIPTION OF DRAWINGS

The invention will be better understood by an examination of the following description together with the accompanying drawings in which.

DESCRIPTION OF PREFERRED EMBODIMENTS

Figure 1:
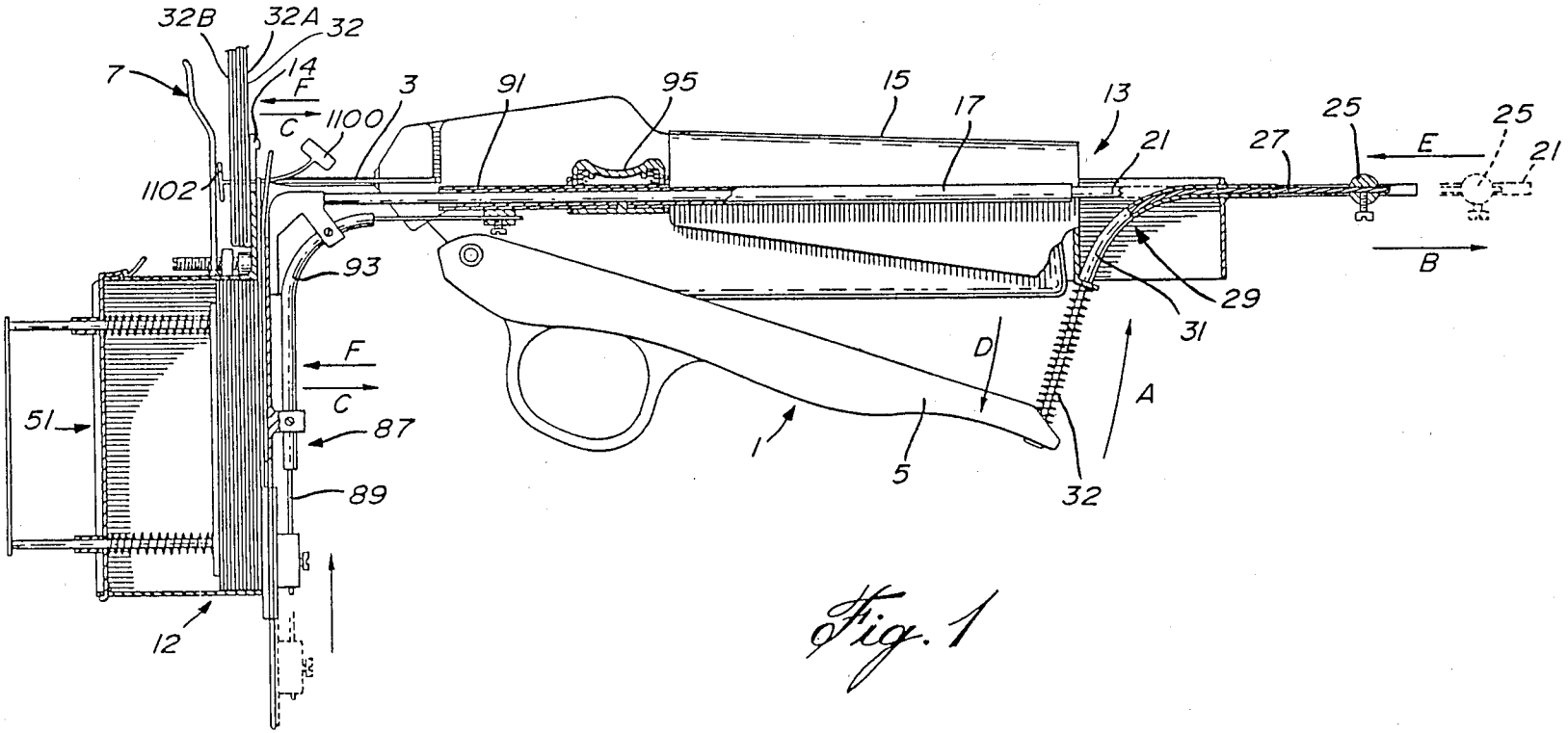
FIG. 1 is a side view of the fastener dispensing device with attachments with the trigger means of the fastener dispensing device in its rest position.

Referring to the drawings, a fastener dispensing device of the above-described nature is illustrated generally at 1 and includes a stationary hollow needle member 3 at the front end thereof, the hollow needle member having a free front end. The device also includes a trigger means 5.

Figure 3:
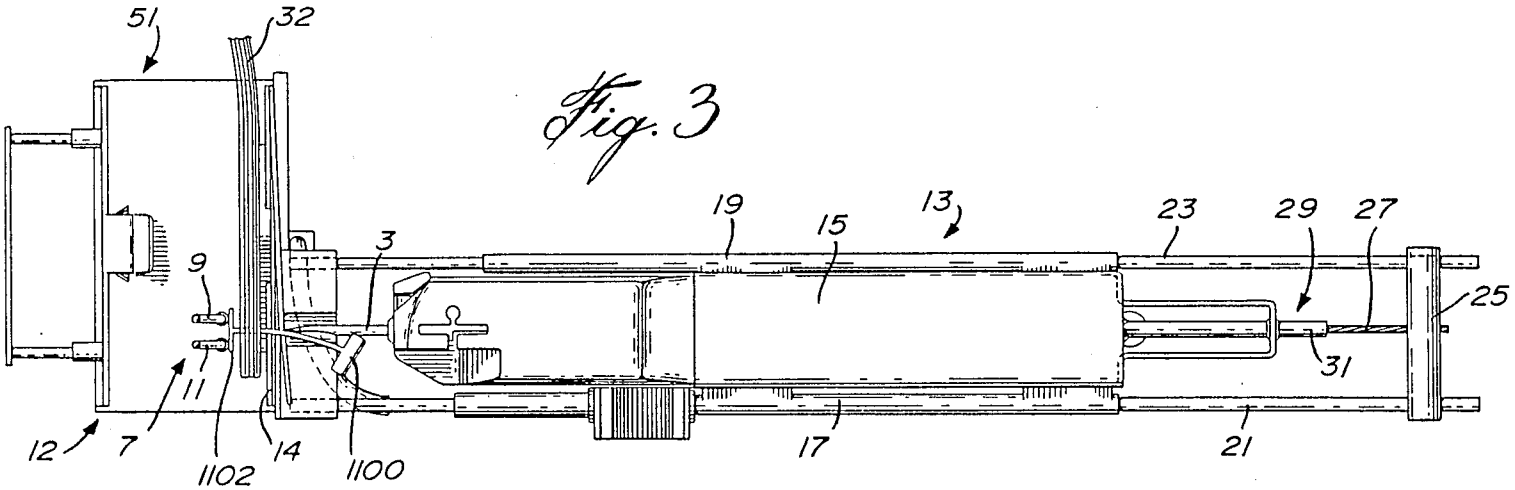
FIG. 3 is a top view of FIG. 1.

In order to automate the product positioning, there is provided, in accordance with the invention, a position means 7 which includes two spaced hook-like fingers 9 and 11 (see FIG. 3). The fingers 9 and 11 are disposed on a carrier 12 on either side of the hollow needle 3. As will be seen below, in the illustrated embodiment, the carrier 12 comprises the tag dispenser and it includes a backplate 14.

In order to automate the step of bringing the positioned product to the needle, there is provided a moving means illustrated generally at 13. The moving means comprises the carrier 12 and a saddle 15 which is mounted on the device 1. Attached to each side of the saddle are guide members comprising tubular members 17 and 19. As can be seen, the tubular members are disposed in parallel arrangement. In addition, the tubular members are parallel to the needle 3.

Extending through the tubular members 17 and 19 are sliding members comprising rods 21 and 23 respectively which rods are slidable within their respective tubes. The rods are connected together by bar 25 at the rear end of the device 1. The rear end of the device is, as clearly seen, the end opposite to the end having the needle 3. The front ends of the rods 21 and 23 are connected to the carrier 12.

A force transmitting means, such as a cable 27 is connected at one end thereof to the trigger means 5 and, at the other end thereof, to the bar 25. The cable extends through a guide means 29 which includes a curved tubular member 31, whereby the cable is guided to the bar 25. The guide means 29 may also include a handle return means such as spring 32, should such a return means be necessary.

Figure 2:
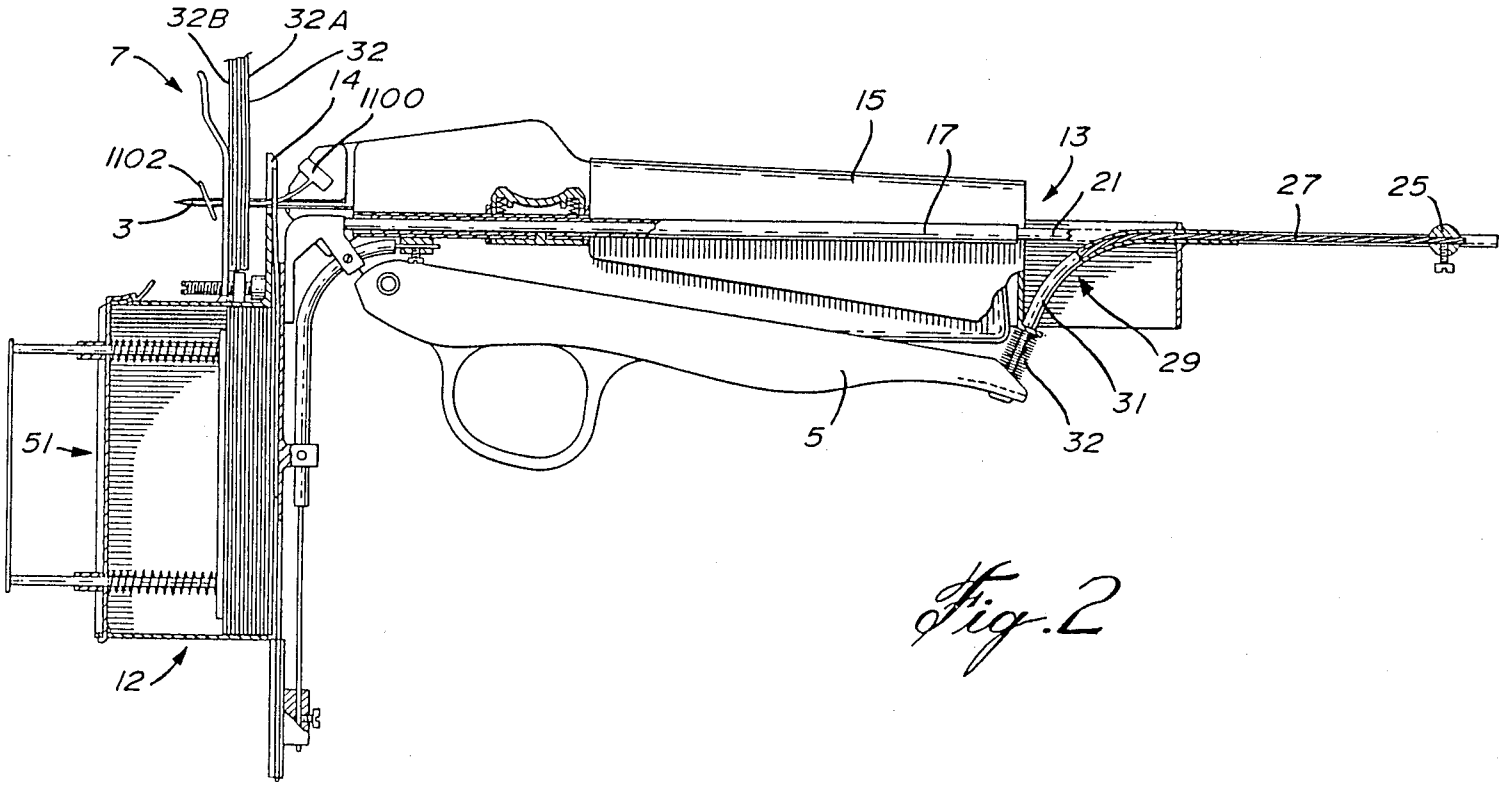
FIG. 2 is the same view as FIG. 1 but with the triggering means of the fastener dispensing device in its fully retracted position.

In operation, the apparatus is in its rest position as illustrated in solid lines in FIG. 1. The operator then places the apparatus to position a portion 32 of a product between the fingers 9 and 11 and the backplate 14. The portion 32 can be, for example, the free edge of a sleeve of a coat, the collar of a coat or blouse, the bottom edge of a garment, etc. The trigger means is then moved in the triggering direction (see direction of arrow A in FIG. 1) to activate the device. At the same time, the cable 27 will be forced upwardly and rearwardly and, as the cable 27 is connected to the bar 25, the bar 25 will be moved rearwardly (in the direction of arrow B in FIG. 1). As rods 21 and 23 are connected to bar 25, they will also move rearwardly in the direction of arrow B, and as these rods are connected to the carrier 12, the carrier 12 will move rearwardly in the direction of arrow C. As the carrier is moved towards the needle, the needle will pierce the portion 32 of the product and pass, from one side 32A of the portion 32, to the other side 32B of the product when the trigger means 5 is in its fully retracted position as shown in FIG. 2. As seen in FIG. 2, the needle extends through the portion 32 of the product beyond the side 32B so that the needle can eject the fastener 100 as taught in the references cited above.

The trigger means 5 is then released so that it moves in the direction of arrow D in FIG. 1. When the trigger means 5 moves in the direction of arrow D, cable 27 is pulled forwardly and downwardly so that bar 25 is moved forwardly in the direction of arrow E. Rods 21 and 23 are moved in the same direction whereby to push the carrier 12 forwardly in the direction of arrow F. At the end of a cycle, as shown in FIG. 1, the fastener 100 is released from the needle. As will be seen below, a tag or label can be mounted on the fastener whereby the tag or label will be attached to the product.

Figure 4:
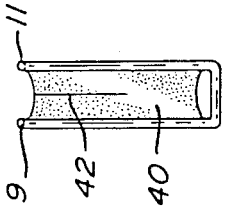
FIG. 4 illustrates a further modification of the invention.

In order to assist in the ejection of the fastener 100 from the needle, a web 40 may be disposed between the fingers 9 and 11 as shown in FIG. 4. The web can comprise a rubber-like material and would include a central slit 42 which extends to the top of the web. The slit will permit passage of the needle 3 through the web, but will prevent passage of the bar 102 through the web. Thus, the web will assist in the ejection of the fastener 100 from the needle 3.

As will be apparent from FIG. 2, the travel distance of the bar 25 must be sufficient so that the needle 3 will extend beyond the surface 32B of the portion 32 when the trigger means 5 is in its fully retracted position. The travel distance of the bar 25, in the arrangement shown, corresponds identically with the travel distance of the trigger means 5. In the event that this travel distance is not sufficient, it would, of course, be possible to use a motion amplifier, as is well known in the art, to increase the travel distance.

Although the motion of bar 25 is, in the illustrated embodiment, produced by use of a cable 27 between the trigger means 5 and the bar 25, it would be possible to use some other arrangement of motion translation as, for example, an arrangement of gears as also well known in the art. It is only necessary that the motion be produced by the action of moving the triggering means 5 in the triggering direction (arrow A) so that the piercing of the product portion be coincident with the ejection of the fastener 100 from the needle 3.

It can thus be seen that, with the improvements described, an operator need merely position a portion of a product so that the fingers 9 and 11 extend adjacent one surface of the product while the needle 3 is disposed adjacent the other surface. The operator then pulls the trigger, and the improved apparatus automatically completes the fastening operation.

Although the moving means 13 has above been described as consisting of tubular guide members 17 and 19 with respective rods 21 and 23, it will be understood that these tubular members and rods could be replaced by a single guide on one side of the saddle which could comprise a hollow rectangular member. A mating rectangular rod would slide through the guide, and the rectangular rod would be connected, at one end thereof, to the carrier 12 and, at the other end thereof, to either the bar 25 or a replacement therefor.

The improved apparatus also includes a tag dispenser for automatically placing the tags in position to be mounted on the fastener before each fastening operation. In accordance with the invention, a tag is placed in such a position at the termination of a preceding fastening operation for a following fastening operation. The tag is disposed in front of the front end of the needle 3 in the space between the backplate 14 and the needle 3. The timing of the tag positioner must therefore ensure that the holder 12 has moved far enough ahead of the front of the needle 3 so that there is a space between the front end of the needle 3 and the backplate 14 for the tag to move into.

With the above in mind, and considering FIGS. 5, 6, 7, 8 and 9, the tag dispenser comprises a container 51. In the illustrated embodiment, the container is rectangular in both front view and top view.

The container comprises a dispensing wall 53 and an opposed openable opening wall 55. Tags are placed in the container through the opening when the openable wall 55 is opened.

The container also includes end walls 57 and 59, a top wall 61 and a bottom wall 63. Extending downwardly from the dispensing wall 53 is a guide wall 65. Slot 67 extends upwardly through the guide wall 65 and into the dispensing wall 53.

Figure 5:
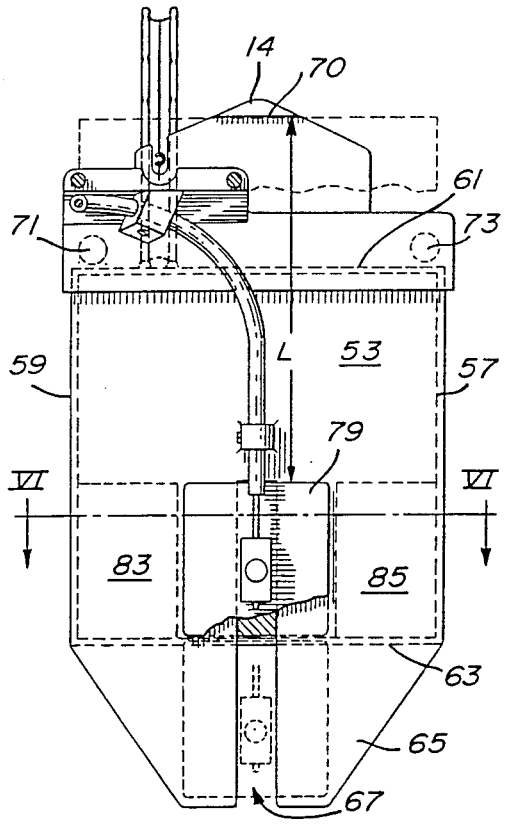
FIG. 5 is a view of the tag dispensing device as seen from the dispensing wall side.
Figure 7:
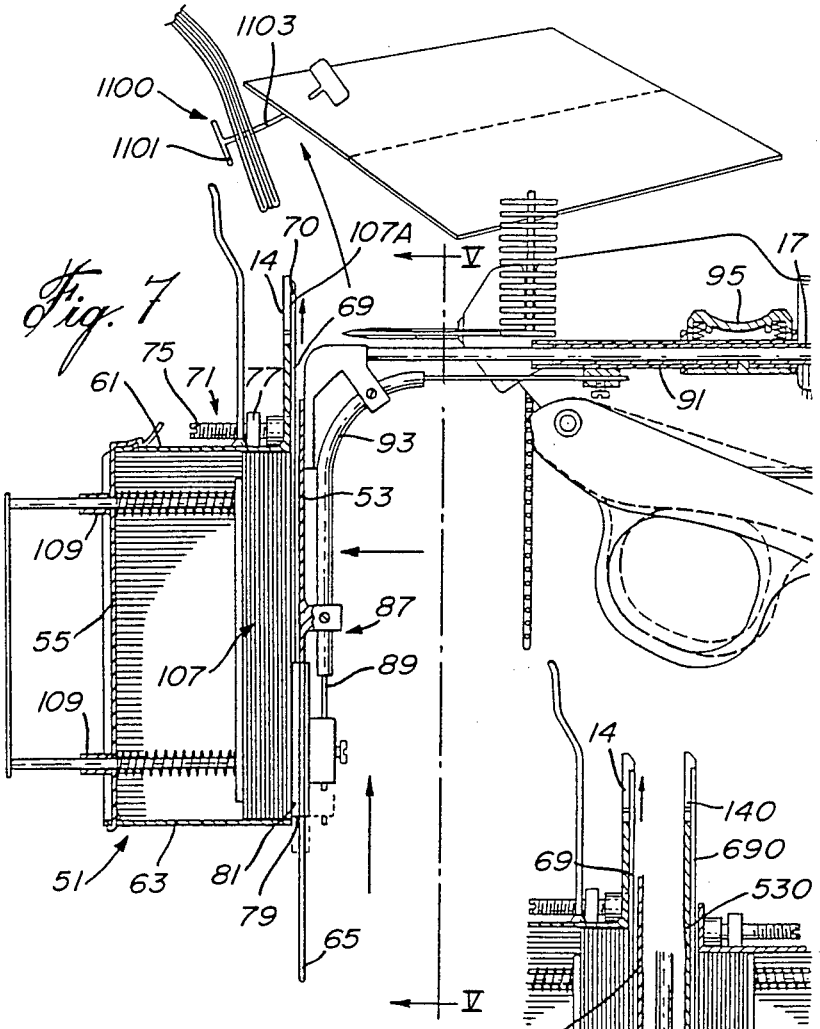
FIG. 7 is a side sectional view of the container of the tag dispenser.

A dispensing opening 69 is formed between the top of the dispensing wall 53 and the backplate 14. As seen in FIGS. 5 and 7, the backplate 14 includes a stop comprising a ridge 70 the purpose of which will be discussed below.

The width of the dispensing opening is of the order of the thickness of two tags to be dispensed. As tags may be of different thicknesses, a dispensing opening adjustment means 71 and 73 are included adjacent to the dispensing opening. Adjustment means 71 comprises a screw 75 and a threaded screw holder 77. Adjustment means 73 comprises a similar arrangement. Thus, the effective width of the dispensing opening can be adjusted by moving the screw 75 backwards or forwards in the screw holder 77. A similar adjustment would be made on the adjustment means 73 side.

A slider 79 is movable up and down along walls 53 and 65 and is guided in this movement by the slot 67. The slider 79 comprises a pusher portion 81 shown in FIGS. 6 and 7. The pusher section has a thickness equal to the thickness of two tags.

Disposed on the interior surface of the dispensing wall 53 are spacers 83 and 85. Each of the spacers 83 and 85 has a thickness T equal to the thickness of a single tag. The tops of the spacers 83 and 85 are in line with the top of the pusher 81 in its most upward position.

As mentioned, pusher 81 is movable vertically up and down along the slot 67. The movement is effected by an arrangement 87 (see FIGS. 7, 8 and 9) which includes a cable 89 connected at one end to the slider 79 and, at the other end, to a cylinder 91. As can be seen, the cylinder 91 is mounted on and slideable over the cylinder 17. The cable is guided from the slider 79 to the cylinder 91 by a guide means comprising a curved cylinder 93.

In accordance with the invention, the tag dispenser will operate either manually or automatically. In order to switch from manual to automatic mode and vice-versa, there is provided a thumb actuated release mechanism 95 which includes a pin 97 for engagement in opening 99 in cylinder 17 and aligned opening 100 in cylinder 91. When the pin 97 extends through both openings 99 and 100, cylinder 91 is physically connected to cylinder 17 and will move together with cylinder 17. This will hereinafter be referred to as the engagement position.

Springs 101 maintain the mechanism 95 in the engagement position.

In operation, in the automatic mode, the mechanism 95 is retained in the engagement position. Accordingly, cylinder 91 will move with cylinder 17 in the directions of the arrow G (see FIG. 9) causing cable H to move in the directions of arrow H. The mechanism is changed to the manual mode by placing the thumb in the curve portion of the mechanism and pressing downwardly in the direction of arrow I (see FIG. 8). Pin 97 will move out of opening 99 so that cylinder 91 is now free to move by sliding over the cylinder 17, i.e. it will no longer move with the cylinder 17. However, pin 97 will still be engaged in opening 100 of cylinder 91. Accordingly, when mechanism 95 is moved, cylinder 91 will move with it. The mechanism 95 can be manually moved in the directions of the arrow G whereupon the cable 89 will be caused to move in the directions of the arrow H of FIG. 9.

As can be seen, the cable 89 is connected to slider 79 by a cylinder and screw arrangement 103, and the cable 89 is connected to the cylinder 91 by a cylinder and screw arrangement 105, whereupon the cable is removable at both ends thereof.

Figure 6:
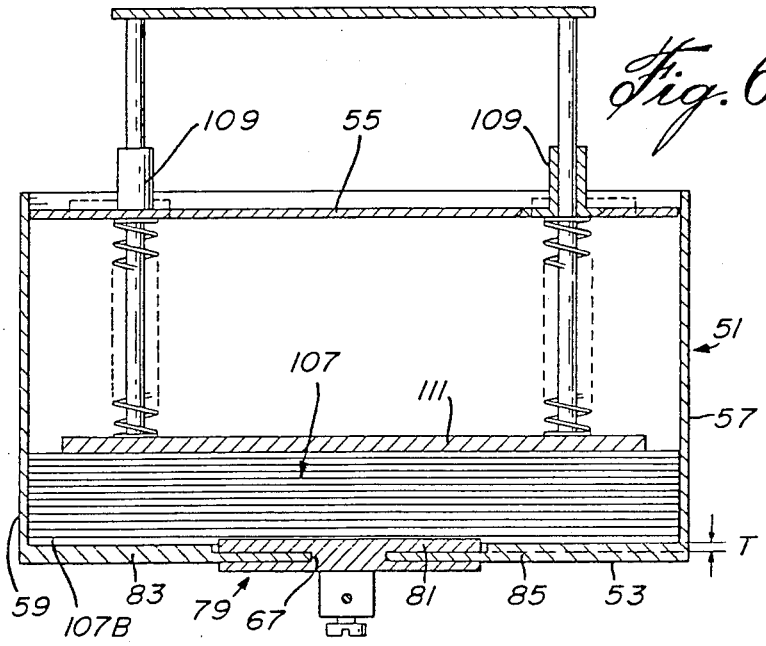
FIG. 6 is a section through VI—VI of FIG. 5.
Figure 8:
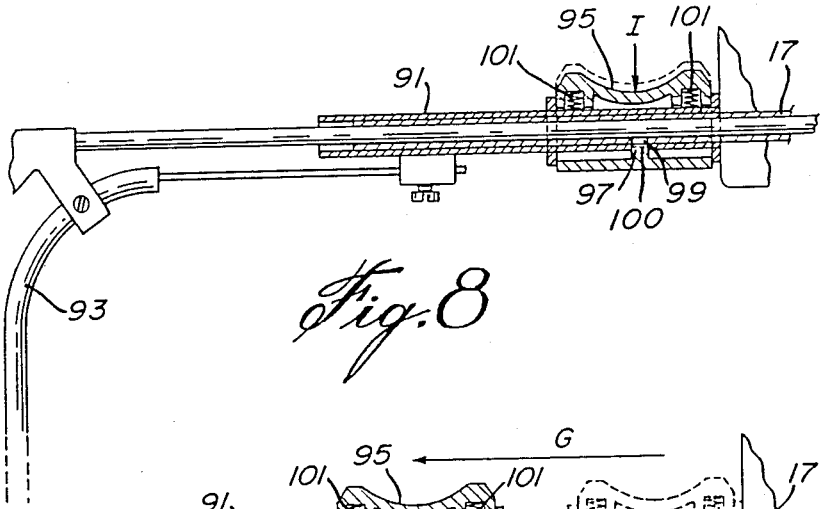
FIGS. 8 and 9 illustrate the operation of the thumb activated mechanism.

As can be seen in FIGS. 6 and 7, the tags 107 are stacked in a vertically upright position. A spring 109 and plate 111 arrangement forces the tags up against the dispensing wall 53. The spring and plate arrangement is a schematic representation, and other physical arrangements, well known in the art, could be used for this same purpose.

In operation, a first tag 107A is placed in position so that the top of the tag abuts the ridge 70 as shown in FIG. 7. This can be accomplished manually by placing the thumb in the mechanism 95, pressing downwardly, and then moving the mechanism to the left as far as it will go. This will place the slider in the position illustrated in full lines in FIG. 9, i.e., underlying the container 51. As seen in FIG. 6, although the pusher 81 is of a thickness equal to two tags, as the spacers 83 and 85 are each of a thickness equal to one tag, the pusher 81 will engage only one tag 107B. When the mechanism 95 is moved back to the right, the one tag is moved upwardly until the top of the tag abuts the ridge 70. The length L between the ridge and the top of the spacers 83 and 85 is equal to the length of a tag. Thus, when a tag is in the position of tag 107A of FIG. 7, its inner surface will be in line with the inner surfaces of the spacers 83 and 85. A second tag will occupy the position illustrated at 107B in FIG. 6 and be engageable by the pusher 81 when it is moved into the position shown in full lines in FIG. 9. Because the dispensing opening 69 has a thickness equal to the thickness of two tags, it will be possible to move the second tag 107B upwardly and through the opening even while the first tag 107A is in the opening.

Figure 9:
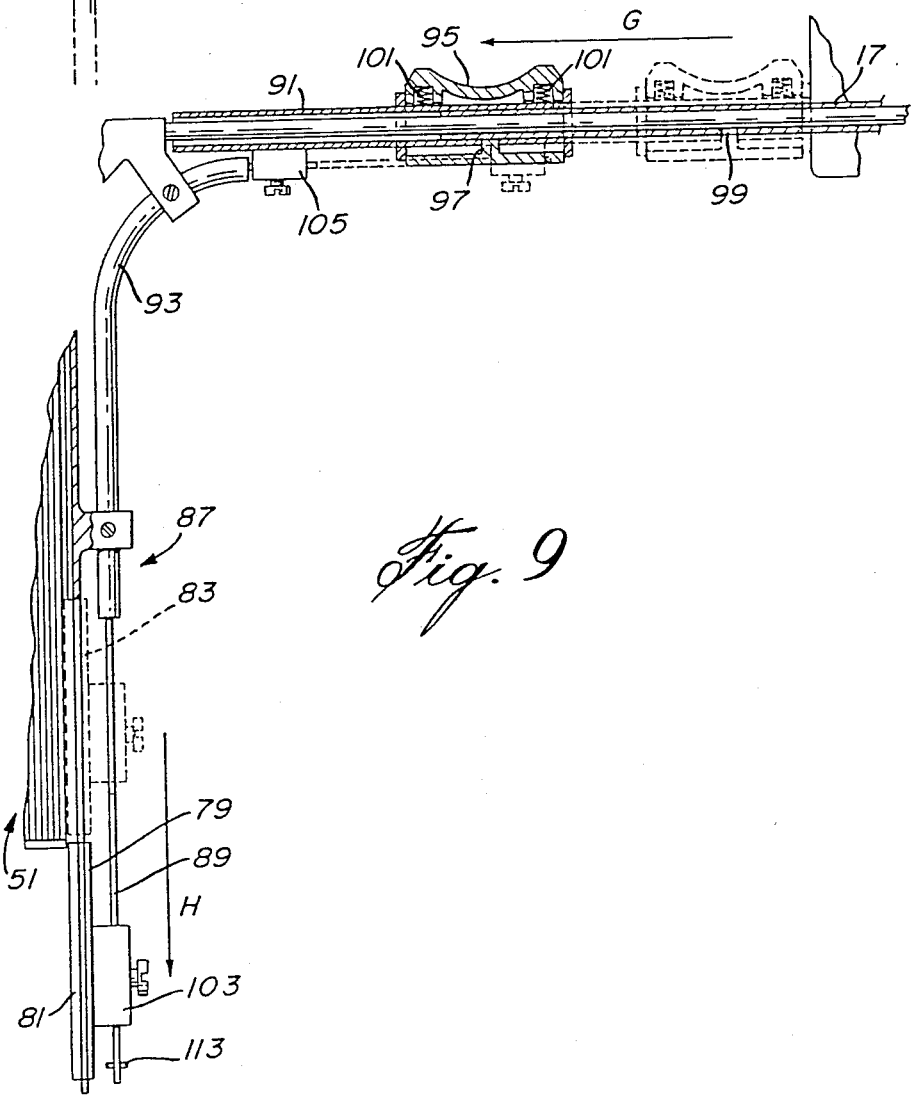

Assuming now that the mechanism is in the automatic position, when the trigger means 5 is moved in the triggering direction (in the direction of arrow A of FIG. 1) the slider 79 is moved downwardly and, when the triggering means is in its fully retracted position, will occupy the position shown in full lines in FIG. 9. When the triggering means 5 is released, the slider 79 will begin to move upwardly even as the carrier 12 begins to move away from the needle. It will be clear that the movement of the slider 79 must be synchronized with the movement of the carrier 12 so that the second tag does not reach the level of the needle 3 until such time as the needle 3 has cleared the dispensing opening 69. Such an adjustment can be made by means well known in the art. For example, as shown in FIG. 9, the cable 89 could be made slideable in the cylinder 103, and a collar 113 could be disposed adjacent the free end of the cable. Thus, the cylinder 103 will not move until such time as the collar 113 abuts it.

In any case, a second tag will move up behind the first tag and, in its movement, it may possibly engage the strand 103 of the fastener 100 and push the first tag upwardly. However, as the first tag is about to be removed in any case, this has no effect on the operation of the device.

When the first tag is pulled out, it may frictionally engage the second tag and attempt to pull it out as well. However, the second tag will be stopped by the ridge 70 so that it will remain in position for the next fastening operation.

It will be seen that, with a tag dispenser above-described, and in what could be referred to as a double-feeding method, the first tag does not have to be ejected before the second tag is raised to be in position for the next fastening operation. Accordingly, a lesser raising motion is required for the tags.

In comparison with prior art devices, where a first tag must be ejected before a second one can be placed in position for a fastening operation, the motion of the slider would have to be equal to at least the full length of a tag dispensed by the dispenser. When using a dispenser as above-described, it is possible, as seen in the drawings, to raise each tag by an amount far smaller than the total length of the tag. Thus, the slider 79 requires a shorter stroke.

Such advantage is especially useful with dispensing devices of the type illustrated at 1 herein as it is the motion of the triggering means 5 which provides the motion of the slider. As the motion of the triggering means 5 is limited, it is useful to have a tag dispenser wherein the slider requires only a short stroke.

A further advantage of the tag dispenser of the present application when compared to tag dispensers of the prior art, which may be referred to as single feeding dispensers, is that with the present tag dispenser, the second tag can start moving not only while the first tag is still in position, but even while the needle is still extending through the first tag. In the prior art devices, the second tag cannot start moving until such time as the first tag has been completely removed from the tag dispenser. The earliest that the first tag can be removed from the first dispenser is when the needle member no longer extends therethrough. As this occurs only after approximately three quarters of the motion of the triggering means 5 has been expended, it leaves very little motion to raise the second tag into the dispensing position. Accordingly, with a single feeding tag dispenser, it would be necessary to either amplify the motion of the triggering means 5 for its last quarter, or to provide some other complicated and cumbersome arrangement. The much simpler arrangement of the present invention is possible because of the double feeding method. With this method, it is only necessary to ensure that the second tag does not arrive in position until such time as the needle has withdrawn from the position.

In the manual mode, the initial set-up is, once again, as illustrated in FIG. 7. The mechanism 95 is kept pressed down while the trigger means is retracted and released. After the first tag is removed, the mechanism 95 is moved first to the left and then to the right to thereby place a second tag in position so that the set-up is once again as illustrated in FIG. 7. With this arrangement, it is not necessary to be able to pass a second tag through the dispensing opening 69 while a first tag is in the dispensing opening. Accordingly, the dispensing opening can be made equal to the thickness of only a single tag. Similarly, the pusher need have a thickness equal to only a single tag, and spacers 83 and 85 are not needed. It is also possible, in accordance with the invention, to dispense labels instead of tags, and the labels could be contained on a roll. The pusher 81 would then be replaced with, for example, pins which would engage mating openings in each label.

Figure 10:
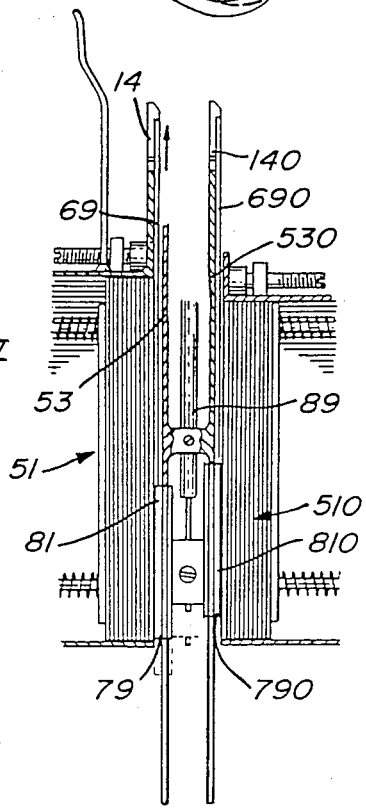
FIG. 10 illustrates an embodiment of the invention incorporating two back-to-back tag dispensers.

In some instances, it is necessary to fasten two tags to a product at the same time. An arrangement for automatically accomplishing this is also possible in accordance with the invention as illustrated in FIG. 10. As shown in FIG. 10, such an arrangement would use two back-to-back containers 51 and 510. The container 510 includes a dispensing wall 530, a backplate 140 and a dispensing opening 690. A single cable 89 is connected to both slider 79 of container 51 and slider 790 of container 510. Thus, by operation of the single cable 89, two tags will be dispensed at the same time.

The slider 790, and more importantly the pusher 810 of the container 510 can be made of a different height than the slider 79 and pusher 81 of the container 51. Accordingly, it is possible not only to fasten two different tags at the same time, but to fasten two different tags of different sizes at the same time.

As will be apparent, it will be possible to construct a moving means as a separate attachment to the fastener dispensing device. It is also possible to construct the tag dispenser as a separate attachment to the device.

It is also possible to use the tag dispenser for apparatus other than the dispensing device illustrated herein so that the tag dispenser, especially the automatically operable embodiment, could be constructed as a separate device for use with other dispensing devices.

Finally, it is possible to construct the moving means and the tag dispenser as a single integral attachment. Thus, it is possible to improve the fastener dispensing device by the simple expedient of adding the appropriate attachment as required.

Alternatively, it is possible to integrally form with the fastener dispensing device the moving means or to integrally form with the fastener dispensing device the tag dispenser. Finally, the holding means and tag dispenser could be integrally formed with the fastener dispensing device. In any of the latter options, an integrally formed improved fastener dispensing device is provided.

It will also be apparent to one skilled in the art that although mechanical means are provided for causing movement of the moving means 13 and the slider 79, other means may provide this movement. For example, pneumatic arrangements (including air cylinders), as is well known in the art, could be provided for this purpose.

Although particular embodiments have been described, this was for the purpose of illustrating, but not limiting, the invention. Various modifications, which will come readily to the mind of one skilled in the art, are within the scope of the invention as defined in the appended claims.

I claim:

1. A fastener and tag dispensing device, said device comprising a trigger means for activating, when moved in a triggering direction, a push rod to extend through a hollow needle member, whereby to anchor a fastener in a pierceable product;

the improvement comprising:

positioning means for positioning said product so that one side of said product is adjacent the front end of said needle member;

a tag dispenser comprising means for automatically placing a tag in front of said needle member in response to activating said trigger means;

moving means for moving said positioning means and said tag towards said needle member, said moving means being activated to move towards said needle member when said trigger means is moved in said triggering direction;

whereby, said product and said tag are caused to approach said needle member, to be pierced by said needle member, and to slide on said needle member so that said needle member extends through said product and tag, and the front end of said needle member extends beyond the other side of said product and tag a sufficient distance for the dispensing device to dispense a fastener and tag so that when said product is removed from said positioning means, a fastener and tag are attached thereto.

2. The improvement as defined in claim 1 wherein said moving means is activated to move towards said needle member by the action of said trigger means when said trigger means is moved in said triggering direction.

3. The improvement as defined in claim 1 wherein said positioning means positions said product such that it is substantially perpendicular to said needle member.

4. The improvement as defined in claim 1 wherein said positioning means comprise two spaced fingers placed in front of the front end of said needle member on either side of the needle member to hold the material taut and rigid therebetween;

said spaced fingers being movable towards the front end of said needle member and past the front end of said needle member on either side of said needle member when activated by the trigger means;

whereby said needle member will extend through the product.

5. The improvement as defined in claim 4 and further including a rubber web extending between said spaced fingers;

a slit extending centrally of said web to permit passage of said needle member therethrough.

6. The improvement as defined in claim 1 further including:

at least one guide member disposed longitudinally of the dispensing device and parallel to the needle member and fixedly mounted on dispensing device;

a movable member extending through the guide member and movable relative to the guide member;

carrier means for carrying the spaced fingers;

one end of said movable member being attached to the carrier means;

a force transmitting means connected at one end thereof to the triggering means;

the other end of the force transmitting means being connected to the other end of the movable member;

whereby, when the triggering means is moved in the triggering direction, the force transmitting means will force the movable member, and therefore, the carrier means and spaced fingers to move rearwardly towards said needle member.

7. The improvement as defined in claim 6 wherein said moving means further includes a saddle means fixedly mounted on said dispensing device;

a first guide member mounted on one said of said saddle means longitudinally of the dispensing device and parallel to the needle member;

a second guide member mounted on the other side of said saddle means parallel to said first guide member;

a first movable member extending through said first guide member, and a second movable member extending through said second guide member, said first and second movable members each being connected at the front ends thereof, to said carrier means;

a bar connecting said movable members at the rear ends thereof;

the other end of said force transmitting means being connected to said bar;

whereby, when said trigger means is moved in the triggering direction, said force transmitting means forces said bar rearwardly to thereby force said rods rearwardly to thereby force said carrier means rearwardly to thereby force said spaced fingers rearwardly towards said needle member.

8. The improvement as defined in claim 7 wherein said force transmitting means comprises a cable, and further including guide means for guiding said cable from said trigger means to said bar.

9. The improvement as defined in claim 8 wherein said guide members comprise elongated cylinders and wherein said movable members comprise elongated rods extending through said cylinders.

10. The improvement as defined in claim 1 wherein said tag dispenser comprises a tag container, said tag container comprising:

a top wall, a dispensing wall, a backplate and spaced fingers carried on said top wall and disposed substantially parallel to said backplate;

a dispensing opening in said top wall through which said tags are dispensed; and slide means, slidable along said dispensing wall, for pushing a tag out of said tag container through said dispensing opening;

said product being positioned between said backplate and said spaced fingers.

11. The improvement as defined in claim 10 and further including means for moving said slide means in synchronism with said trigger means.

12. The improvement as defined in claim 11 wherein said means for moving said slide means comprises a second cable connected, at one end thereof, to said trigger means, and, at the other end thereof, to said slide means; and guide means for guiding said second cable.

13. The improvement as defined in claim 10 and further including a second tag dispenser disposed in back-to-back relationship with said tag dispenser;

said means for substantially simultaneously placing a tag from both said tag dispenser and said second tag dispenser in front of said needle before each fastening cycle;

whereby, before each fastening cycle, there will be two tags disposed in front of said needle.

14. The improvement as defined in claim 13 wherein each tag dispenser comprises a tag container, each said tag container comprising a top wall and a dispensing wall;

a dispensing opening in the top wall of each of said tag containers through which said tags are dispensed;

said dispensing wall of said tag container being disposed adjacent to the dispensing wall of said second tag container; and a single slide means slideable along and between said dispensing walls for pushing a tag out of each tag container through the dispensing openings thereof;

and further including means for moving said slide means manually.

15. The improvement as defined in claim 14 wherein the first said tag container is adapted to hold tags of a different size than said second tag container;

whereby there will be two tags of different sizes in front of said needle member before each fastening cycle.

16. The improvement as defined in claim 1 and further comprising a tag dispenser, said tag dispenser comprising means for manually placing a tag in front of said needle member before each fastening cycle.

17. The improvement as defined in claim 16 wherein said tag dispenser comprises a tag container, said tag container comprising:

a top wall, a dispensing wall, a backplate and spaced fingers carried on said top wall and disposed substantially parallel to said backplate;

a dispensing opening in said top wall through which said tags are dispensed; and slide means, slidable along said dispensing wall, for pushing a tag out of said tag container through said dispensing opening;

said product being positioned between said backplate and said spaced fingers;

and further including means for moving said slide means manually.

18. The improvement as defined in claim 1 and further including a second tag dispenser disposed in back-to-back relationship with said tag dispenser;

said means for substantially simultaneously placing a tag from both said tag dispenser and said second tag dispenser in front of said needle before each fastening cycle;

whereby, before each fastening cycle, there will be two tags disposed in front of said needle.

19. The improvement as defined in claim 18 wherein each tag dispenser comprises a tag container, each said tag container comprising a top wall and a dispensing wall;

a dispensing opening in the top wall of each of said tag containers through which said tags are dispensed;

said dispensing wall of said tag container being disposed adjacent to the dispensing wall of said second tag container; and a single slide means slideable along and between said dispensing walls for pushing a tag out of each tag container through the dispensing openings thereof.

20. The improvement as defined in claim 19 and further including means for moving said slide means in synchronism with said trigger means.

21. The improvement as defined in claim 20 wherein said means for moving said slide means comprises a second cable connected, at one end thereof, to said trigger means, and, at the other end thereof, to said slide means; and guide means for guiding said second cable.

22. The improvement as defined in claim 21 wherein one said tag container is adapted to hold tags of a different size than the other said tag container;

whereby there will be two tags of different sizes in front of said needle member before each fastening cycle.

* * * * *